United States Patent [19]

Tetreault

[11] Patent Number: 4,484,684

[45] Date of Patent: Nov. 27, 1984

[54] PARTS SEPARATOR

[76] Inventor: Merritt D. Tetreault, 248 Yew St., East Douglas, Mass. 01516

[21] Appl. No.: 378,620

[22] Filed: May 17, 1982

[51] Int. Cl.[3] ..... B07C 9/00

[52] U.S. Cl. ..... 209/616; 198/613; 209/663; 425/215

[58] Field of Search ..... 209/606, 616, 615, 663, 209/667, 671, 689; 425/215, 217, DIG. 51; 198/613, 692, 693

[56] References Cited

U.S. PATENT DOCUMENTS

| | | | |
|---|---|---|---|
| 58,359 | 9/1866 | Petrie et al. | 198/613 |
| 2,114,263 | 4/1938 | Heaslet | 209/616 |
| 3,142,375 | 7/1964 | Luke | 198/613 |
| 3,517,477 | 6/1970 | Thornton | 209/606 |
| 3,651,938 | 3/1972 | Suellentrop, Jr. | 209/663 |
| 3,982,632 | 9/1976 | DeLeon | 209/616 |

*Primary Examiner*—Robert B. Reeves
*Assistant Examiner*—Donald T. Hajec
*Attorney, Agent, or Firm*—Blodgett & Blodgett

[57] ABSTRACT

A parts separator for separating molded plastic parts from sprue-runner elements. The separator comprises a supporting frame, a hollow drum mounted for rotation about a first horizontal axis and constituting an outer separator element, and an inner separator element mounted within the drum for rotation about a second horizontal axis which is spaced from and parallel with the first axis. The drum has a plurality of apertures in its outer surface and the inner separator element includes a plurality of pins which extend through the apertures, so that rotation of the inner and outer separator elements about their respective axes causes the outer end of each pin to reciprocate within the aperture between an inner position wherein the end of the pin is flush with the outer surface of the drum to an outer position wherein the end of the pin extends substantially beyond the outer surface of the drum. The inner and outer separator elements are drivingly interconnected for simultaneous and synchronous rotation and a conveyor delivers the parts and sprue-runner elements to the outer surface of the drum.

11 Claims, 4 Drawing Figures

10
38
48
14
17
18
48
16
46
20
III
48
46a
47
52
48a
III
44
37
34
20a
46
30
22
46
48
48
48
20

X
Y
46
34
46
46a
16
20
48
52
48a
20a
20
48
40
44
52
48a
17
42
47
20a
18
26
28
37
12
22
30
24
32
36
34
X
Y

PARTS SEPARATOR

BACKGROUND OF THE INVENTION

This invention is directed to a machine for separating plastic parts from sprue-runner elements.

A common problem in the molded plastics industry is the separation of molded plastic articles from the scrap sprue-runner elements. The parts and sprue-runner elements are ejected simultaneously from the plastic molding machines onto a conveyer which delivers them to the separator. Typically, the sprue-runner elements are substantially longer than the parts. The prior art separator elements have made use of this size differential to separate the parts from the sprue-runner elements. One typical separator, for example, comprises a large rotatably driven cylindrical roll which is provided with a plurality of pins projecting from the outer surface of the roll. The parts and sprue-runner elements are delivered by the conveyor to the ascending side of the roll. The end of the conveyor is spaced from the roll and the lateral spacing between the adjacent pins is greater than the largest dimension of each part, so that the parts fall between the drum and conveyor to a receptacle to be collected. However, the lateral spacing of adjacent pins is less than the length of each sprue-runner element, so that the sprue-runner elements are engaged by the pins as they ascend and are carried to the opposite side of the drum where they fall to a second receptacle, to be collected.

One of the major problems with prior art separators is that, occasionally, a sprue-runner element becomes caught by the pins, so that the element does not fall when it reaches the opposite side of the roll. The element is then carried around beneath the roll to the ascending side of the roll where it becomes entangled with other elements. Eventually, an entanglement of elements develops in which case parts are also carried to the opposite side of the cylinder where they fall into the second receptacle for the sprue-runner elements. Finally, the separator loses its ability to separate parts from sprue-runner elements altogether and the entanglement of parts and elements causes the machine to jam, resulting in serious damage to the machine.

Sometimes, the sprue-runner elements get caught in the driving elements of the machine even before a serious entanglement develops thereby, causing damage to the driving element. The sprue-runner elements are usually still hot when they reach the roll and are likely to stick to the roll. This further compounds the problem of entanglement of the elements with the pins. These and other difficulties experienced with the prior art devices have been obviated in a novel manner by the present invention.

It is, therefore, an outstanding object of the invention to provide a parts separator in which pins are mounted for axial movement relative to the outer surface of the roll so that they are fully extended on the ascending side of the roll for engaging the sprue-runner elements and are withdrawn on the descending side of the roll to ensure disengagement of the elements from the roll.

Another object of this invention is the provision of a parts separator which is divided into an outer separator element and an inner separator element in which the outer separator element includes a roll with apertures in the outer surface thereof and in which the inner separator element includes pins which are movable axially in the apertures with respect to the outer surface of the roll.

A further object of the present invention is the provision of a parts separator comprising an outer separator element which includes a cylindrical roll with apertures and an inner separator element which includes pins mounted for axial movement in the apertures relative to the outer surface of the roll and in which the outer and inner separator elements are drivingly connected for simultaneously and synchronous rotation.

It is another object of the instant invention to provide a parts separator comprising an outer separator element which includes a roll having apertures in its outer surface and which is mounted for rotation about a first axis and, an inner separator element mounted for rotation within the outer separator element about a second axis and which includes pins which extend through the apertures for axial movement within the apertures relative to the upper surface of the drum.

A still further object of the invention is the provision of a parts separator in which the outer and inner separator elements are drivingly interconnected by means of the pins which extend through the apertures in the drum.

It is a further object of the invention to provide a parts separator in which the drive components are outside of the separating area to avoid entanglement with the sprue-runner elements.

It is a further object of the invention to provide a parts separator which is simple in construction, which is relatively inexpensive to manufacture, and which is capable of a long-life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a parts separator for separating molded plastic parts from sprue-runner elements. The separator comprises a supporting frame, an outer separating element consisting of a hollow drum mounted for rotation relative to the frame about a first horizontal axis and an inner separator element located within the drum and mounted for rotation relative to the frame about a second horizontal axis which is parallel from and spaced from the first horizontal axis. The inner separator element includes a plurality of pins which extend through corresponding apertures in the drum, so that rotation of the inner and outer separator elements about their respective axes causes the outer end of each pin to reciprocate relative to the outer surface of the drum from an inner position in which the outer end is substantially flush with the outer surface of the drum to an outer position in which the outer end of the pin extends substantially beyond the outer surface of the drum. One of the separator elements is rotated about its axis by drive means so that each pin reaches its inner position when it is descending and its outer position when it is ascending. The parts and sprue-runner elements are delivered to the ascending side of the drum by a conveyor, so that the parts fall between the drum and conveyor and the sprue-runner elements are engaged by the ascending pins and carried to the descending side of the drum where they fall to be collected separately from the parts.

More specifically, the inner separator element is rotatably driven by the drive means and causes the outer separator element to be rotatably driven by means of the pins which extend through the apertures in the drum.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
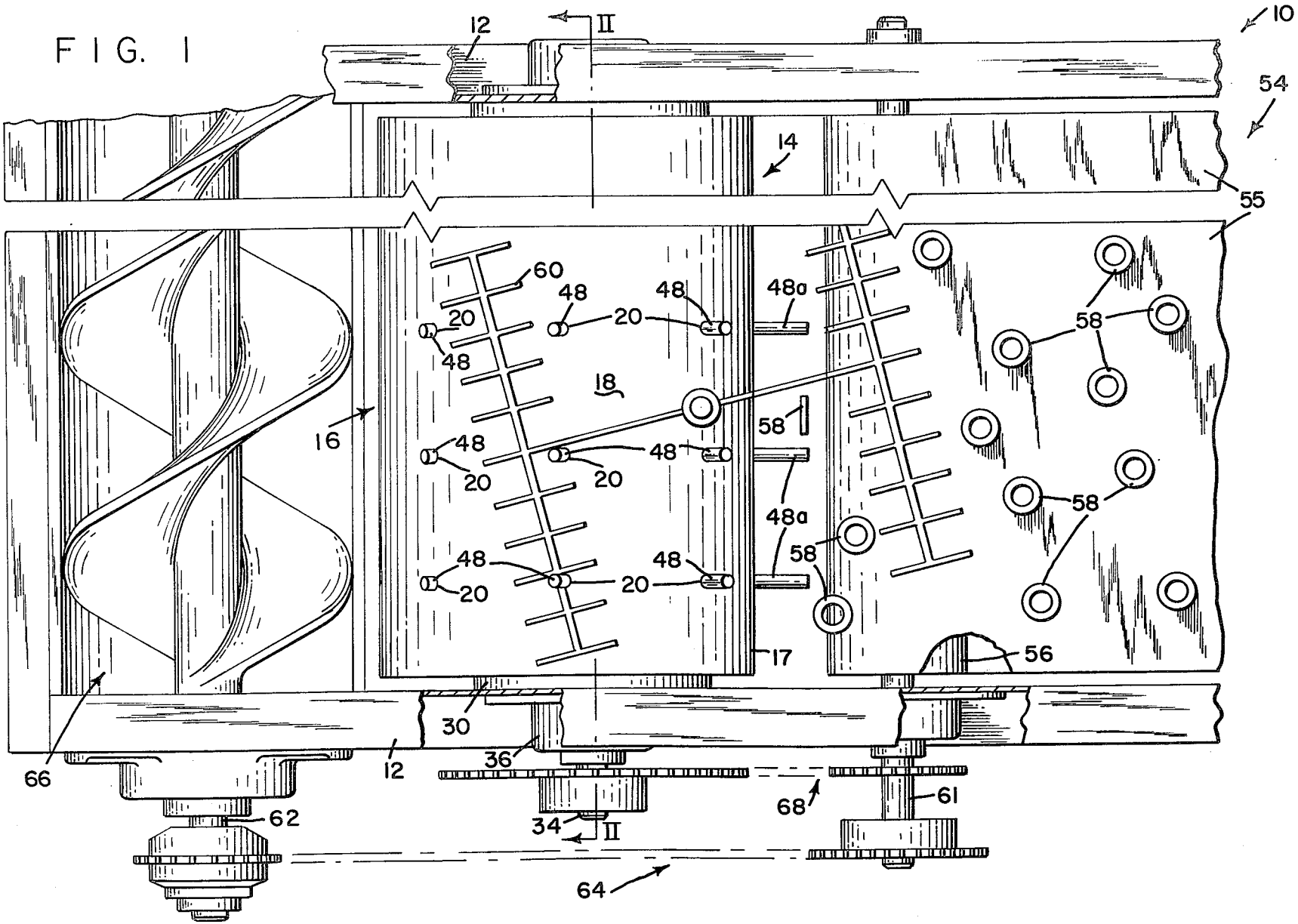
FIG. 1 is a plan view of the parts separator embodying the principles of the present invention.
Figure 2:
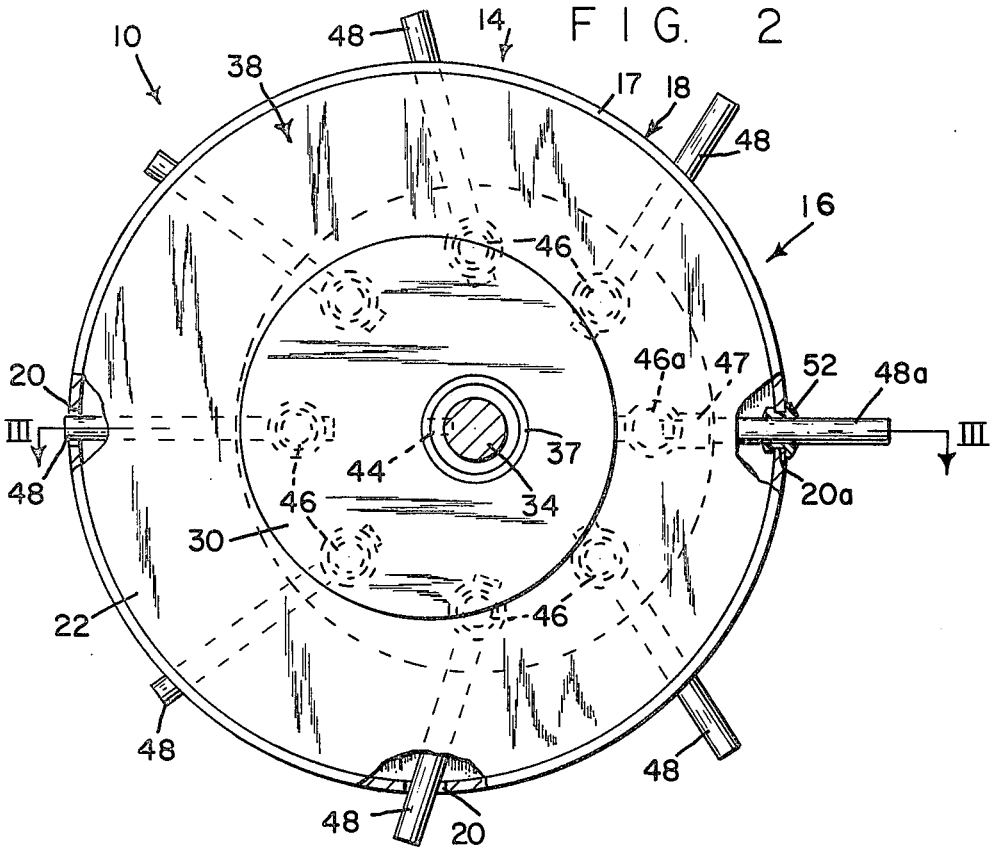
FIG. 2 is a vertical sectional view of the parts separator taken on the line II—II of FIG. 1.
Figure 3:
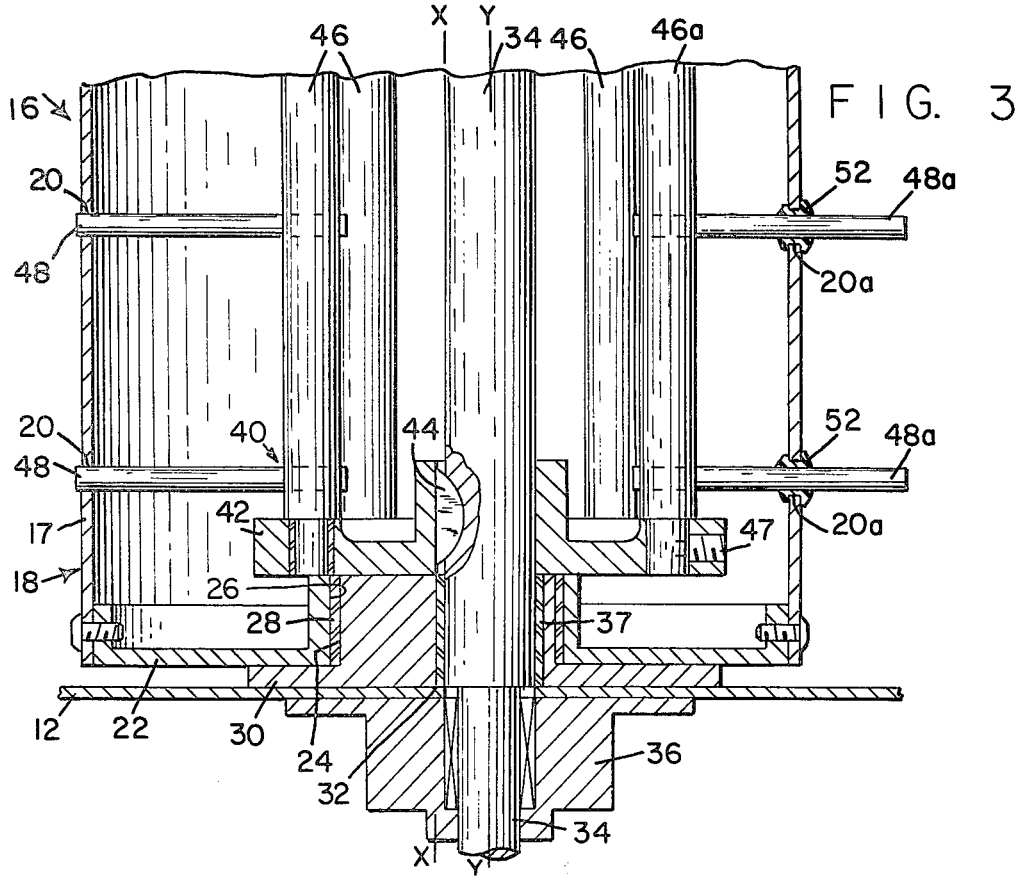
FIG. 3 is a horizontal sectional view of the parts separator taken on the line III—III of FIG. 2.

Referring first to FIGS. 1-3, which best show the general features of the invention, the parts separator is generally indicated by the reference numeral 10.

The parts separator 10 comprises a frame 12 and an outer separator element generally indicated by the reference numeral 14. The outer separator element 14 includes a hollow drum 16 having an annular outer wall 17 which has an annular outer surface 18 which is concentric with a first horizontal axis X—X. The wall 17 is provided with a plurality of apertures 20 arranged in a plurality of spaced longitudinal rows, which are best illustrated in FIG. 1. The drum 16 also includes, at each end thereof, a vertical end wall 22 which has a central opening 24 defined by an inner annular surface 26 which is concentric about a first horizontal axis X—X. The annular surface 26 is in rotary sliding contact with the outer annular surface of a sleeve 28. The sleeve 28 forms an outer bearing surface of an eccentric bushing 30 which is secured to the frame 12. The inner annular surface 26 of the opening 24, the outer surface of the bushing 28 and the outer surface 18 of the drum are all concentric about the first horizontal axis X—X. The eccentric bushing 30 has an annular opening 32 for receiving a drive shaft 34. The opening 32 and the drive shaft 34 are concentric about a second horizontal axis Y—Y which is parallel with and spaced from the first axis X—X. The opening 32 is lined with a sleeve 37 which is made of a material having a low coefficient of friction such as plastic or oil impregnated wood and which allows the shaft 34 to rotate freely within the sleeve 37. The sleeve 28 is also constructed of a material having a low coefficient of friction such as plastic or oil impregnated wood.

The parts separator 10 also includes an inner separator element, generally indicated by the reference numeral 38, which is located within the drum 16. The inner separator element 38 includes a hub, generally indicated the reference numeral 40. Each end of the hub 40 consists of a supporting member 42 which is engaged for rotation with the shaft 34 by means of a key 44. A plurality of spindles 46 are pivotally mounted in the supporting members 42, except for one of the spindles which is identified by the reference numeral **46*a* in FIG. 3. Spindle 48*a* is fixed against pivoting relative to the supporting members 42 by a set screw 47. Each spindle 46 has a plurality of pins 48 extending outwardly therefrom through corresponding apertures 20 in the drum 17. All of the pins 48 extend freely through their respective apertures with the exception of the pins 48*a* which extend from the spindle 46*a*, as shown in FIG. 2. Each pin 48*a* extends through a bushing 52 in the apertures 20*a*. The bushings 52 are constructed of a material which is both flexible and has a low coefficient of friction, as for example nylon, which allows each pin 48*a* to slide freely along its central longitudinal axis relative to the bushing 52. The pins 48*a* function as drive elements inter-connecting the inner separator elements 38 and the outer separator element 14. Rotation of the hub 40 by the drive shaft 34 about the axis Y—Y causes the drum 16 to rotate about the axis X—X by means of the pins 48*a*. The remaining pins 48 simply follow along with the drum as the drum rotates. The horizontal longitudinal axes of the spindles 46, including the spindle 46*a*, are at the same distance from the axis Y—Y. As the hub 40 rotates, the longitudinal axis of each spindle rotates in a circle which is concentric with the axis Y—Y. Since the outer separator element 14 and the inner separator element 38 rotate about different axes, the outer ends of the pins 48 rotate in a circle which is horizontally offset from the circle in which the apertures 20 rotate. Because of this, there is axial movement of each pin 48 relative to its respective aperture 20 as the inner and outer separator element rotate simultaneously about their respective axes of rotation. This causes the outer end of each pin to reciprocate relative to the outer surface 18 of the drum from an inner position in which the outer end of the pin is substantially flush with the outer surface 18 as shown at the extreme left of FIG. 2 to an outer position in which the outer end of the pin extends substantially beyond the outer surface 17 of the drum, as shown at the extreme right of FIG. 2. The pins 48 reach their outer position on the ascending side of the drum 16** and reach their inner position on the descending side of the drum.

Referring particularly to FIG. 1, the parts and sprue-runner elements to be separated are delivered to the parts separator by means of a conveyor generally indicated by the reference numeral 54 which comprises a belt 55 trained around a drive roll 56. The forward end of the belt 55 which extends around the drive roll 56 is located on the ascending side of the drum 16 and is spaced from the drum so that the pins 48 clear the end of the belt, as shown in FIG. 1. The parts and sprue-runner element are conveyed from a plastic molding machine, not shown, toward the left as viewed in FIG. 1. The spacing between adjacent pins in each row is greater than the dimension of the parts to be separated and less than the length of the sprue-runner elements. The parts are indicated by the reference numeral 58 and the sprue-runner elements are indicated by the reference numeral 60.

When each pin 48 in its outer or inner position, its central longitudinal axis intersects the X and Y axis, so that it extends straight through the aperture 20 at a right angle to the outer surface 18 of the drum. Since the pin **48*a* is fixed to its spindle 46*a*, the central axis of the pin 48*a* continues to intersect the axis Y—Y. However, the axis of the pin 48*a* does not intersect the axis X—X as it moves from the outer position to the inner position and from the inner position to the outer position. This causes the pin 48*a* to move out of its right angle relationship with the outer surface 18** of the roll.

The axis of each aperture 20 intersects the axis X—X. When the axis of the pin **48*a* is no longer aligned with the X—X axis, it is also no longer co-axial with the axis of the aperture. This causes the pin 48***a* to become slightly misaligned with its aperture 20*a*. However, since the bushing 52 is made of a resilient material, it deforms to compensate for this misalignment while at the same time, permits the pin 48*a* to slide axially within the bushing 52. Each of the remaining pins 48 is also aligned with its respective aperture 20 when it is in the outer position or the inner position. As each pin 48 moves from its extreme outer or inner position, it also becomes misaligned with its aperture 20. However, each aperture 20 is elongated in plane of rotation to compensate for this misalignment. Since the spindle 46 is free to pivot, the pin 48 extends through its aperture 20 in a very lose fashion and is limited in its pivoting motion by the sides of the aperture. By having one row of pins fixed and driving the drum and having the remaining pins pivotally mounted to float in their apertures, binding between the pins and the drum is prevented.

Figure 4:
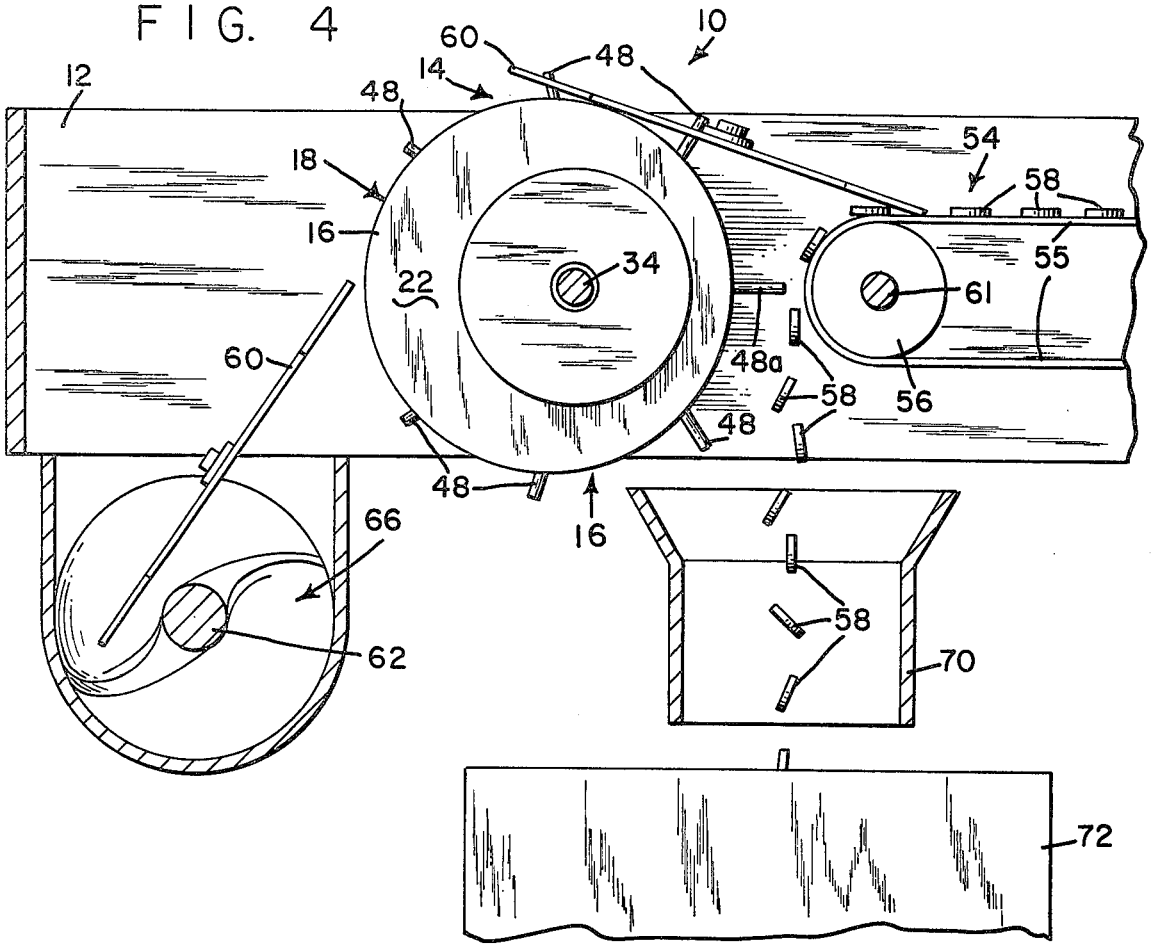
FIG. 4 is a diagrammatic side elevational view of a parts separator, portions being in section.

The roll 56 is driven from an auger shaft 62 through a chain and sprocket drive, generally indicated by the reference numeral 64. The auger shaft 62 is in turn driven from an electric motor not shown and forms part of an auger comminuting device, generally indicated by reference numeral 66. The comminuting device 66 is located on the descending side of the drum 16 and is located below the drum 16, see also FIG. 4. The drive shaft 34 is driven from the conveyor drive shaft 61 through a chain and sprocket drive, generally indicated by the reference numeral 68.

The operation and advantages of the present invention will now be readily understood in view of the above description. As viewed in FIGS. 1 and 4, the parts 58 and their sprue-runner elements 60 are conveyed by the conveyor belt 55 from the plastic molding machine, not shown, to the left as viewed in FIGS. 1 and 4 toward the drum 16. When the parts 58 reach the end of the conveyor, they fall into the space between the drum and the end of the conveyor and between the pins 48 through a chute 70 into a receptacle 72. The sprue-runner elements 60 being considerably longer than the part 50, span the space between the conveyor and the drum 16 and are engaged by the pins 48 as they ascend through the space between the drum 16 and the conveyor belt 55. The sprue-runner elements 60 are then carried across the top of the drum to the descending side of the drum. Since the pins 48 gradually withdraw from their fully extended position adjacent the conveyor belt 55 to their fully withdrawn position on the descending side of the drum, they are no longer in engagement with the sprue-runner elements. The sprue-runner elements 60 are, therefore, free to fall into the auger comminuting device 66, wherein they are comminuted into reusable scrap plastic. If, on occasion, a sprue-runner element adheres to the outer surface of the roll since it may be still hot and sticky, it will be carried under the drum and back to the ascending side of the drum. This allows time for the sprue-runner element to cool and become loosened from the outer surface of the drum. In addition, the sliding movement of the pins relative to the drum also assists in disloding the sprue-runner from the surface of the drum, so that it falls free of the surface of the drum when it reaches the descending side of the drum.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Parts separator for separating molded plastic parts from their relatively elongated sprue-runner elements, comprising:

(a) an outer frame, (b) an outer separator element, including a hollow drum mounted for rotation relative to the frame about a first horizontal axis, said drum including an outer annular wall having an outer annular surface which is concentric with said first axis and a plurality of spaced apertures extending through the wall, (c) an inner separator element located within the drum and mounted for rotation relative to the frame about a second horizontal axis which is parallel with and spaced from the first horizontal axis, said inner and outer separator elements being drivingly interconnected for simultaneous and synchronous axial rotation, said inner separator element including a plurality of elongated pins which extend laterally from said second horizontal axis, each of said pins having a free outer end which extends through a respective one of said apertures, so that rotation of said outer and inner separator elements about said first and second horizontal axes, respectively, causes the outer end of each pin to reciprocate relative to the outer surface of the drum from an inner position in which said outer end is substantially flush with said outer surface to an outer position in which said outer end extends substantially beyond said outer surface, said inner and outer separator elements being drivingly interconnected through at least some of the pins which function as driving pins, said inner separator element comprising a hub which is concentric with the second horizontal axis and rotatable about said second horizontal axis, said driving pins being fixed to said hub and arranged in a horizontal row which is parallel with said second horizontal axis, each of said pins other than said driving pins being pivotally mounted on the hub about an axis which is parallel with the second horizontal axis, and wherein the apertures for said other pins are larger than the pins in the rotational planes of the apertures and their respective pins to compensate for forward and rearward movement of each of said other pins relative to its respective aperture, due to the eccentricity of the first and second horizontal axes, said other pins and their respective apertures being arranged in a plurality of horizontal rows which are parallel with the second horizontal axis, said hub comprising a supporting member at each end of the hub, and a plurality of spindles supported by the supporting members so that they are spaced from and parallel with the second horizontal axis, each spindle being fixed to a row of pins, the spindle for the row of driving pins being fixed against axial rotation and the remaining spindles being mounted in the supporting members for axial rotation, (d) drive means for rotating said inner separator element about said second horizontal axis of rotation and thereby causing said inner separator element to rotate the outer separator element about said first horizontal axis of rotation, so that each pin reaches its inner position when it is descending and its outer position when it is ascending, and (e) a conveyor for delivering molded plastic parts and sprue-runner elements to the ascending side of the outer surface of the drum, said conveyor being spaced from the drum so that the parts fall between the separator elements and the conveyor and the sprue-runner elements are engaged by the ascending pins and carried to the descending side of the drum where they fall to be collected separately from the parts.

2. Parts separator for separating molded plastic parts from their relatively elongated sprue-runner elements, comprising:

(a) a supporting frame, (b) an outer separator element, including a hollow drum mounted for rotation relative to the frame about a first horizontal axis, said drum including an outer annular wall having an outer annular surface which is concentric with said first axis and a plurality of spaced apertures extending through the wall, (c) an inner separator element located within the drum and mounted for rotation relative to the frame about a second horizontal axis which is parallel with and spaced from the first horizontal axis, said inner and outer separator element being drivingly interconnected for simultaneous and synchronous axial rotation, said inner separator element including a plurality of elongated pins which extend laterally from said second horizontal axis, each of said pins having a free outer end which extends through a respective one of said apertures, so that rotation of said outer and inner separator elements about said first and second horizontal axes, respectively, causes the outer end of each pin to reciprocate relative to the outer surface of the drum from an inner position in which said outer end is substantially flush with said outer surface to an outer position in which said outer end extends substantially beyond said outer surface, (d) drive means for rotating said inner separator element about said second horizontal axis and thereby causing said inner separator element to rotate the outer separator element about said first horizontal axis so that each pin reaches its inner position when it is descending and its outer position when it is ascending, said drive means comprising a drive shaft which extends through the outer and inner separator elements and is concentric with the second horizontal axis, said inner separator element being fixed for rotation with the drive shaft, each end of the outer separator element comprising a vertical wall which forms part of the drum and which has a central opening defined by an annular inner horizontal bearing surface which is concentric with the outer annular horizontal surface of the drum, an eccentric bushing which is fixed to the frame, said eccentric bushing having an annular opening which is concentric with the second horizontal axis and through which said drive shaft extends for axial rotation relative to the eccentric bushing, said eccentric bushing also having an outer annular bearing surface which is concentric with said first horizontal axis and is located within the central opening for relative rotary sliding contact with said inner bearing surface and thereby functions as a bearing surface for axial rotation of the drum, and (e) a conveyor for delivering molded plastic parts and sprue-runner elements to the ascending side of the outer surface of the drum, said conveyor being spaced from the drum so that the parts fall between the separator elements and the conveyor and the sprue-runner elements are engaged by the ascending pins and carried to the descending side of the drum where they fall to be collected separately from the parts.

3. Parts separator as recited in claim 2, wherein one of said annular bearing surfaces comprises a sleeve which is made of a material having a coefficiency of friction which is substantially lower than that of the drum and the eccentric bushing.

4. Parts separator as recited in claim 2, wherein a bearing sleeve is located between the drive shaft and the annular opening of the eccentric bushing, said sleeve being made of a material having a coefficiency of friction which is substantially less than that of the shaft and the eccentric bushing.

5. Parts separator as recited in claim 2, wherein said drive shaft is journaled for rotation within annular opening of the eccentric bushing.

6. Parts separator for separating molded plastic parts from their relatively elongated sprue-runner elements, comprising:

(a) a supporting frame, (b) an outer separator element, including a hollow drum mounted for rotation relative to the frame about a first horizontal axis, said drum including an outer annular wall having an outer annular surface which is concentric with said first axis and a plurality of spaced apertures extending through the wall, (c) an inner separator element located within the drum and mounted for rotation relative to the frame about a second horizontal axis which is parallel with and spaced from the first horizontal axis, said inner separator element comprising:

(1) a hub which is concentric with the second horizontal axis and mounted for rotation about said second horizontal axis, (2) a plurality of elongated driving pins which are fixed to the hub and arranged in a horizontal row which is parallel with said second horizontal axis, each of said driving pins extending laterally from said second horizontal axis and having a free outer end which extends through a respective one of said apertures, and (3) a plurality of elongated non-driving pins which are pivotally connected to said hub about horizontal axes which are parallel with and spaced from said second horizontal axis, each of said non-driving pins having a free outer end which extends through a respective one of said apertures, wherein rotation of said hub about said second horizontal axis causes said driving pins to rotate said outer separator element about said first horizontal axis and causes the outer end of each of said driving and non-driving pins to reciprocate relative to the outer annular surface of the drum from an inner position in which the outer end of each pin is substantially flush with said outer surface to an outer position in which the outer end of each pin extends substantially beyond said outer annular surface, (d) drive means for rotating said hub about said second horizontal axis and thereby causing said inner separator element to rotate the outer separator element about said first horizontal axis, so that each pin reaches its inner position when it is descending and its outer position when it is ascending, and (e) a conveyor for delivering molded plastic parts and sprue-runner elements to the ascending side of the outer surface of the drum, said conveyor being spaced from the drum so that the parts fall between the separator elements and the conveyor and the sprue-runner elements are engaged by the ascending pins and carried to the descending side of the drum where they fall to be collected separately from the parts.

7. Parts separator as recited in claim 6, wherein said non-driving pins and apertures are arranged in a plurality of rows which are parallel with said first and second horizontal axes, the spacing between adjacent corresponding pins in each row being greater than the largest dimension of the parts and less than the smallest dimension of the sprue-runner elements.

8. Parts separator as recited in claim 6, wherein the apertures are larger than the pins in the rotational planes of the apertures and their respective pins to compensate for forward and rearward movement of each pin relative to its respective aperture, due to the eccentricity of the first and second horizontal axes.

9. Parts separator as recited in claim 6, wherein said non-driving pins and their respective apertures are arranged in a plurality of horizontal rows which are parallel with the second horizontal axis, wherein said hub comprising a supporting member at each end of the hub, and a plurality of spindles supported by the supporting members so that they are spaced from and parallel with the second horizontal axis, each spindle being fixed to a row of pins, the spindle for the row of driving pins being fixed against axial rotation and the remaining spindles being mounted in the supporting members for axial rotation.

10. Parts separator as recited in claim 6, wherein each aperture which is associated with a driving pin is provided with a bushing.

11. Parts separator for separating molded plastic parts from their relative elongated sprue-runner elements, comprising:

(a) a supporting frame, (b) an outer separator element, including a hollow drum mounted for rotation relative to the frame about a first horizontal axis, said drum including an outer annular wall having an outer annular surface which is concentric with said first axis and a plurality of spaced apertures extending through the wall, (c) an inner separator element located within the drum and mounted for rotation relative to the frame about a second horizontal axis which is parallel with and spaced from the first horizontal axis, said inner separator element including a plurality of elongated pins which extend laterally from said second horizontal axis, said inner and outer separator elements being drivingly interconnected for simultaneous and synchronous axial rotation through at least some of said pins, each of said pins having a free outer end which extends through a respective one of said apertures, so that rotation of said outer and inner separator elements about said first and second horizontal axes, respectively, causes the outer end of each pin to reciproate relative to the outer surface of the drum from an inner position in which said outer end is substantially flush with said outer surface to an outer position which said outer end extends substantially beyond said outer end surface, (d) drive means including a drive shaft which is rotated about its central longitudinal axis and which extends through the outer and inner separator elements, the central longitudinal axis of said drive shaft being coaxial with said second horizontal axis, said drive shaft being operatively connected to said inner separator element for rotating said inner separator element about said second horizontal axis and thereby causing said inner separator element to rotate said outer separator element about said first horizontal axis of rotation, so that each pin reaches its inner position when it is descending and its outer position when it is ascending, and (e) a conveyor for delivering molded plastic parts and sprue-runner elements to the ascending side of the outer surface of the drum, said conveyor being spaced from the drum so that the parts fall between the separator elements and the conveyor, and the sprue-runner elements are engaged by the ascending pins and carried to the descending side of the drum, where they fall to be collected separately from the parts.

* * * * *